US005585027A

United States Patent [19]

Young

[11] Patent Number: 5,585,027

[45] Date of Patent: Dec. 17, 1996

[54] MICROWAVE SUSCEPTIVE REHEATING SUPPORT WITH PERFORATIONS ENABLING CHANGE OF SIZE AND/OR SHAPE OF THE SUBSTRATE

[76] Inventor: Robert C. Young, 329 E. 88 St., Apt. 4W, New York, N.Y. 10028

[21] Appl. No.: 258,080

[22] Filed: Jun. 10, 1994

[51] Int. Cl.[6] ..... H05B 6/80

[52] U.S. Cl. ..... 219/730; 219/759; 219/732; 426/107; 426/234; 426/243; 99/DIG. 14; 229/902; 206/551

[58] Field of Search ..... 219/730, 759, 219/735, 733, 732, 728; 426/107, 109, 234, 241, 243; 99/DIG. 14; 229/103, 902, 906; 206/551

[56] References Cited

U.S. PATENT DOCUMENTS

| | | | |
|---|---|---|---|
| 4,618,992 | 10/1986 | La Grotteria | 383/4 |
| 4,735,513 | 4/1988 | Watkins et al. | 426/113 |
| 4,777,053 | 10/1988 | Tobelmann et al. | 426/107 |
| 4,814,568 | 3/1989 | Keefer | 219/728 |
| 4,825,025 | 4/1989 | Seiferth | 219/730 |
| 4,870,233 | 9/1989 | McDonald et al. | 219/730 |
| 4,883,936 | 11/1989 | Maynard et al. | 219/730 |
| 4,896,009 | 1/1990 | Pawlowski | 219/730 |
| 4,911,938 | 3/1990 | Fisher et al. | 426/107 |
| 4,938,608 | 7/1990 | Espinosa | 383/7 |
| 4,940,867 | 7/1990 | Peleg | 219/730 |
| 5,014,853 | 5/1991 | Crockett | 229/103 |
| 5,019,680 | 5/1991 | Morino et al. | 219/730 |
| 5,039,833 | 8/1991 | Woods | 219/730 |
| 5,071,062 | 12/1991 | Bradley et al. . | |
| 5,075,526 | 12/1991 | Sklenak et al. | 219/730 |
| 5,077,455 | 12/1991 | Peleg et al. . | |
| 5,110,038 | 5/1992 | Pantisano et al. | 229/103 |
| 5,153,402 | 10/1992 | Quick et al. . | |
| 5,171,594 | 12/1992 | Babbitt | 426/107 |
| 5,180,894 | 1/1993 | Quick et al. . | |
| 5,220,143 | 6/1993 | Kemske et al. | 219/730 |
| 5,223,685 | 6/1993 | Derienzo, Jr. | 219/732 |
| 5,233,144 | 8/1993 | Morino et al. | 219/730 |
| 5,294,765 | 3/1994 | Archibald et al. . | |
| 5,310,977 | 5/1994 | Stenkamp et al. | 219/730 |
| 5,318,818 | 6/1994 | Sjöström | 383/205 |

*Primary Examiner*—Philip H. Leung
*Attorney, Agent, or Firm*—Oliff & Berridge

[57] ABSTRACT

A pattern of tear perforations is provided in the substrate that forms a microwave reheating support. The pattern of tear perforations enables the substrate to be separated into portions so that the substrate can be adjusted in size and/or shape to correspond to the size and/or shape of the food product being heated. For example, a round substrate can include a circular pattern of tear perforations spaced radially inward from an outer circumference of the round substrate. This enables the outer peripheral portion of the round substrate to be removed to reduce the size (diameter) of the substrate for use with smaller-sized food products. The pattern of tear perforations can include one or more lines of tear perforations that extend across a substrate. For example, the lines of tear perforations can divide the circular substrate into a plurality of wedges that can be used, for example, to heat a slice of pizza instead of the entire pizza. Additionally, the line(s) of tear perforations can divide a box or sleeve, which may contain multiple food products (spring-rolls, for example) into individual supports (boxes or sleeves), each containing a single food product.

50 Claims, 8 Drawing Sheets

MICROWAVE SUSCEPTIVE REHEATING SUPPORT WITH PERFORATIONS ENABLING CHANGE OF SIZE AND/OR SHAPE OF THE SUBSTRATE

BACKGROUND OF THE INVENTION

1. Field of the Invention

The present invention relates to food supports, such as, for example, sleeves, boxes, and trays that can be used for heating or reheating food in a microwave oven, and in particular to supports that include a microwave susceptor material that heats when exposed to microwaves so as to be effective in browning and crisping the food product.

2. Description of Related Art

It is known to provide a substrate with a microwave susceptor material so that the substrate can be used as a tray or wrapping for reheating, and possibly browning and crisping, food products. U.S. Pat. No. 4,825,025 to Seiferth discloses a disposable food receptacle (i.e., a tray or a sleeve) for use in microwave cooking that includes a microwave susceptor material so as to brown the exterior of a food product placed in the receptacle. A thin layer of an electrically conductive material, such as an elemental metal is incorporated into the receptacle on the food contacting surface thereof, so that the conductive layer will become heated by the microwave radiation and will, in turn, brown the exterior of the food in the receptacle. The conductive layer is formed as an extremely thin film deposited on a substrate protective layer by a process of vacuum vapor deposition.

U.S. Pat. No. 4,267,420 to Brastad also discloses a flexible wrapper comprised of a plastic film or other dielectric substrate having a very thin coating thereon of an elemental metal such as aluminum.

It is known to provide circular microwave susceptor trays for use with food products such as, for example, pizza pies, so that the pie will be prevented from becoming soggy during microwave heating. The tray contains a microwave susceptor material, such as the materials described in the above-referenced patents, which heats when exposed to microwave energy. The heated tray causes the bottom surface of the pie to brown and become crisped, thus improving the texture of the food product.

While these trays work well with whole pies, when a person chooses to heat only a portion of a pie, the entire tray must be used to support the pie portion in the microwave oven. This results in portions of the tray being entirely exposed (i.e., uncovered by the food product) during microwave heating. The portions of the tray that are not covered during microwave heating become very hot because there is no food product abutting them to absorb the heat from these portions of the tray. These very hot portions can warp or even melt (the susceptor typically is laminated to a plastic protective layer) due to the excessively high temperatures generated therein. This wastes susceptor material, which is relatively expensive compared to the overall cost of the product.

In addition to trays, it is desirable to provide a microwavable substrate in a form that is easy to use with variously sized food products.

U.S. Pat. No. 5,220,143 to Kemske et al. discloses susceptors having disrupted regions for differential heating in a microwave oven. The susceptor consists of variable sized conductive areas whose size is adjusted to compensate for undesirable non-uniform heating patterns. FIGS. 26 and 29 show a susceptor pad having radially inward extending cuts. The cuts are provided so that food products placed near a center of the pad brown equally to those placed near an edge of the pad. The pads of Kemske et al. have large sized susceptor areas in the center region and relatively smaller sized susceptor areas in edge regions. It is believed that the cuts provided in the pad only are located in the surface of the pad to extend through the susceptor layer, but do not extend through the entire pad. Accordingly, Kemske et al. does not recognize the problems addressed by the present invention.

U.S. Pat. No. 4,940,867 to Peleg discloses a box for holding a microwaveable food product. While the box includes a tear strip, the tear strip does not enable the box to be split into smaller portions that are useful with portions of the food product supplied therewith.

U.S. Pat. No. 4,870,233 to McDonald et al. discloses a tray/susceptor combination for use in a microwave oven in which an upper susceptor unit, which overlies the food product, includes a series of longitudinal slits forming a fold line to provide a flange. A series of venting slits also are provided to enable steam and vapors to be vented through the susceptor. McDonald et al. also does not appreciate or address the problems solved by the present invention.

SUMMARY OF THE INVENTION

Accordingly, it is an object of the invention to provide a microwave reheating support that is more useful than existing devices.

In order to achieve the above and other objects, and to overcome the shortcomings detailed above, a pattern of tear perforations is provided in the substrate that forms a microwave reheating support. The pattern of tear perforations enables the substrate to be separated into portions so that the substrate can be adjusted in size and/or shape to correspond to the size and/or shape of the food product being heated.

For example, a round substrate can include a circular pattern of tear perforations spaced radially inward from an outer circumference of the round substrate. This enables the outer peripheral portion of the round substrate to be removed to reduce the size (diameter) of the substrate for use with smaller-sized food products.

Alternatively, the pattern of tear perforations can include one or more lines of tear perforations that extend across a substrate. For example, the lines of tear perforations can divide a circular substrate into a plurality of wedges that can be used, for example, to heat a slice of pizza instead of the entire pizza.

The substrate can be flat, concave or preformed (i.e., pie-pan shaped), or sleeve-like (i.e., in the form of a tube or box). The substrate also can be in the form of a wrap or a preformed bag or pouch.

The substrate can have an uneven shape to facilitate venting. Vent perforations (e.g., voids or holes) can be provided for venting steam from the food product.

BRIEF DESCRIPTION OF THE DRAWINGS

The invention will be described in detail with reference to the following drawings in which like reference numerals refer to like element and wherein.

DETAILED DESCRIPTION OF PREFERRED EMBODIMENTS

Figure 1:
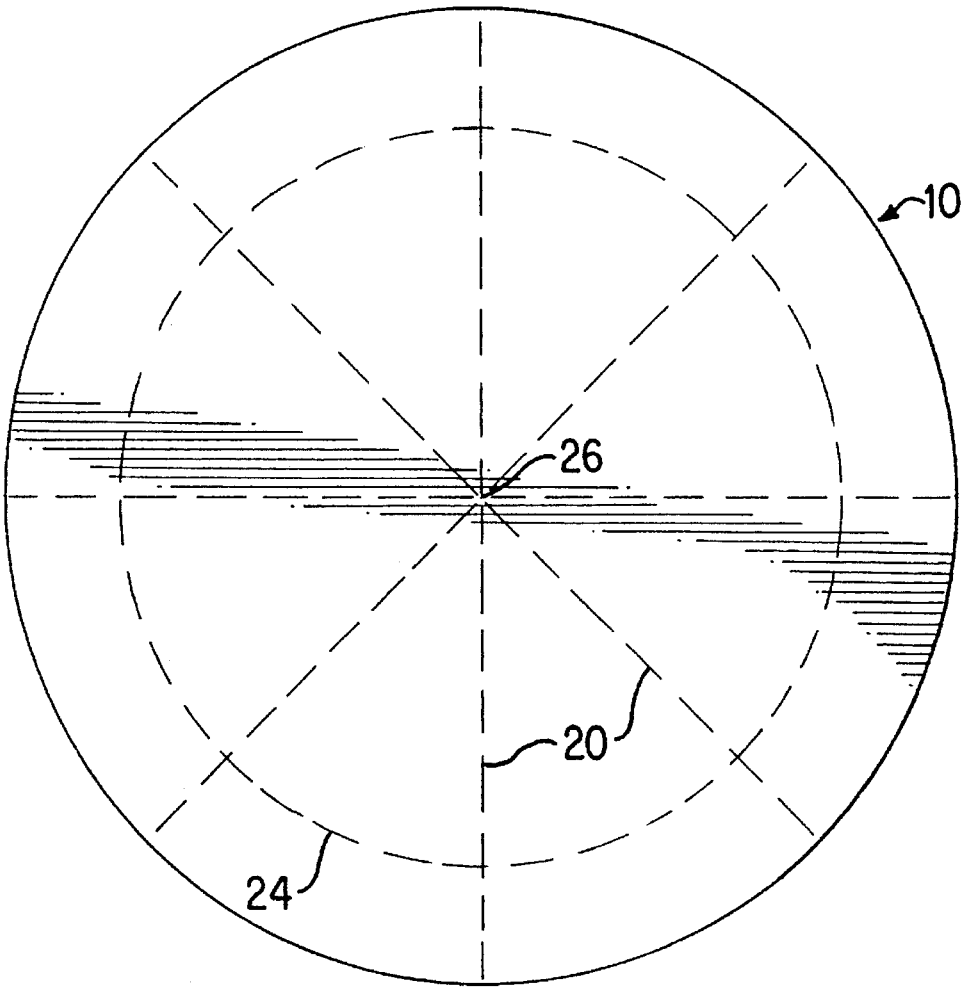
FIG. 1 is a top view of a microwave susceptor support according to a first embodiment of the invention.

FIG. 1 is a top view of a support (or tray) 10 according to a first embodiment of the invention. A support 10 of the first embodiment is circular in shape, and is useful for heating or reheating a circular food product such as a pizza pie. It is understood, however, that the shape of the substrate and the tear perforation patterns provided on the substrate can differ from those illustrated in the drawings, which are provided as illustrations of the invention.

Figure 2:
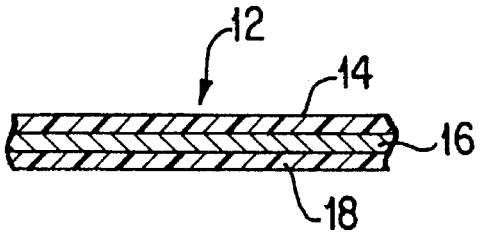
FIG. 2 is a side, cross-sectional view showing the layers contained in the substrate according to the first embodiment of the invention.

Referring to FIG. 2, the support 10 includes a substrate 12 having multiple layers. The substrate 12 in and of itself (i.e., without the tear perforations of the invention) is a material that is well known for use in heating and browning food products in microwave ovens. Accordingly, only a brief description of the layers in substrate 12 is provided.

The uppermost layer, which is designed to be the layer most near to the food product, preferably is a high heat tolerant protective layer 14. Formed below the protective layer 14 is the susceptor material, which is an extremely thin continuous (or discontinuous) layer of conductive material, such as vacuum vapor deposited electrically conductive elemental metals, alloys or oxides 16, for example, a thin layer of elemental aluminum. The combination of the protective layer 14 with the metal layer 16 adhered thereto is mounted (e.g., using all lamination processes, typically adhesive lamination, extrusion lamination and dry lamination processes) on a base layer of structural stock material 18.

Stock material 18 provides structural rigidity and support for the physical shape of the substrate 12, whatever the configuration of the substrate 12 may be. The stock material layer 18 preferably is formed of a low density material having a relatively high insulating capacity and a heat stability sufficient to withstand cooking temperatures in a microwave oven. Suitable materials for use as this stock material 18 are papers, paperboard products, glassine materials, plastics, ceramics and various coated papers. Preferred materials for use in disposable receptacles include coated kraft paper and other conventional kraft paper combinations conventionally used for paperboard cartons and packages.

Protective layer 14 ensures that the food product located on substrate 12 does not contact the metal layer 16 or the stock material layer 18. The protective layer 14 also serves as a stock material onto which the metal layer 16 may be deposited during the construction of the substrate 12. Suitable materials for use in constructing the protective layer 14 include polyesters, nylon, cellophane, polysulfone, polyethylene-terephthalate, and other relatively stable plastic substances. It is preferred that the material of the protective layer 14 be of sufficient stability at high temperatures that it will not degrade during the operation of the microwave oven at the temperature selected for cooking the desired food.

Also included within the substrate 12 is the susceptor metal layer 16 bonded to the rear surface of the protective layer 14 and the food contacting surface of the stock material 18. The metal layer 16 preferably is formed as a vacuum vapor deposited film of electrically conductive elemental-metal, which, as stated above, is preferably deposited on the lower surface of the protective layer 14 before this layer is bonded to the stock material 18. Layer 16 also can be formed from alloys and oxides with either single or dual mode functioning susceptors. That is, any material that functions as a susceptor can be used. The metal layer 16 is extremely thin in terms of its mechanical thickness. Typically, for example, the layer has a thickness in the range between 2 and 700 Å, preferably between 2 and 30Å(immediately after metallization) or 2 and 300Å(after metal cure period). Layer 16 can be formed from numerous well known materials such as, for example, aluminum, tin oxide, chromium, magnesium, silver, gold, ICONEL® stainless steel, members of the stainless steel family, etc. However, aluminum is inexpensive and has been widely used to form susceptor material layers.

For a more detailed discussion of the materials used to form substrate 12, see U.S. Pat. No. 4,641,005 and 4,267,420, referenced above, the disclosures of which are incorporated herein by reference.

The susceptor layer may be continuous in coverage. However, de-metallized and discontinuous metallized layers of design patterns and voids also may be used.

Additionally, more or less layers can be included in the substrate. For example, a further paper (stock) layer can be provided over protective layer 14 as is typical in available microwave popcorn bags.

Tear perforation lines also can be used with corrugated support structures such as those shown in U.S. Pat. No. 4,777,053 to Tobelmann et al. In such an embodiment, the substrate would include a corrugated layer having a flat layer on one or both of its sides; tear perforations and/or raised portions (to be detailed below) and/or vent perforations (to be detailed below) would be included in the substrate. Preferably, the layer that contacts the food product includes a susceptor therein. Thus, the corrugated layer and/or the flat layer(s) can include a susceptor material.

Referring again to FIG. 1, the microwave susceptor support according to the first embodiment is a tray that is circular in shape and includes two patterns of tear perforations. The first pattern includes a plurality of lines 20 of tear perforations that extend entirely across tray 10, passing through a center 26 of the tray. These tear perforation lines enable the tray to be separated easily into smaller portions, for example, for use in heating or reheating portions of a circular food product. In the FIG. 1 embodiment, four tear perforation lines are provided, which divide tray 10 into eight equally sized and shaped 45° wedges. Thus, tray 10 can be separated into halves, quarters, eighths or combinations thereof for heating one-half, one-quarter, one-eighth, etc. of the food product.

The FIG. 1 tray includes a second tear perforation pattern 24 defined by a circular pattern of tear perforations. Circular pattern 24 is spaced radially inward from an outer circumference of round tray 10. This enables an outer peripheral portion of the tray 10 to be removed so that a smaller-size tray results. For example, the diameter of the entire tray 10 could be twelve inches, while the diameter of the smaller tray, defined by the circular tear perforation pattern 24, could be eight inches. This would enable a single tray to be used with different size pizzas. Additional circular tear perforation patterns, for example, a smaller circle concentric with pattern 24 also can be provided.

Each tear perforation extends entirely through all three layers of substrate 12 so that each line of tear perforations defines a separation mechanism by which the tray can be separated easily into smaller portions. The tear perforation patterns are formed by well known devices for placing tear perforations in stock material. The tear perforations are different from vent perforations (to be described below) in that vent perforations are not sized, shaped and arranged to enable easy separation of the substrate into smaller pieces. Typically, although not necessarily, the tear perforations are in the form of small slits. In any event, the tear perforations are arranged close enough to each other, and occupy a large enough percentage of the line (as compared to the portions of substrate material between each tear perforation) to render tear separation easy. The length of the tear perforations (cuts) and the length of spaces between tear perforations depends on the thickness of the substrate and various other factors such as the machine line running speed, for example. A typical cut-to-space length ratio is 2-to-1, for example. A cut having a length of 3/16 inch would be followed by a space having a length of 3/32 inch, for example, in a line of perforations. Typical ranges of dimensions are 3/16–1/4 inches for cut lengths, and 3/32 to 1/8 inches for space lengths, for example.

It also is possible to have the tear perforation pattern on the support match a separation pattern in the food product. For example, if the pizza is sold presliced into four pieces, it would be appropriate to provide tear perforation lines 20° at 90° angles.

Although the second tear perforation pattern 24 illustrated in FIG. 1 is round, it also is possible to form the second tear perforation pattern to have a shape that is different from the shape of tray 10. For example, the second tear perforation pattern could be in the form of a rectangle, oblong, square or a triangle.

Figure 3:
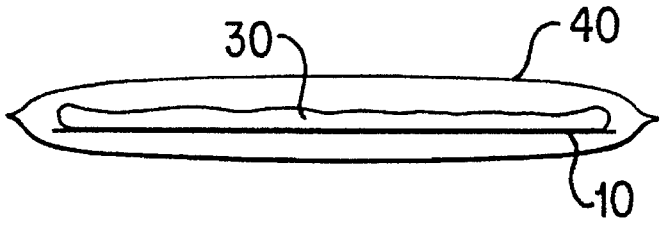
FIG. 3 shows a package containing the microwave susceptor support of the invention and a food product such as a pizza.

As illustrated in FIG. 3, the tray 10 can be sold in combination with a food product 30, such as a pizza, both of which are sealed in a package 40, such as a vacuum-sealed plastic package and/or a cardboard box. Alternatively, tray 10 can be sold as a stand-alone item.

As detailed earlier, during microwave heating, many food products develop moisture and can become soggy. While the use of a support tray having a microwave susceptor layer therein is very helpful for preventing the food from becoming soggy in that it crisps and browns the food product, it also can be useful to provide the substrate with an uneven surface to allow vapor to escape from the surface of the food product. For example, raised elements, embossing or creasing can be used to render the support surface uneven. To further assist cooking vapors to escape from between the food surface and an uneven or even susceptor substrate, large aperture vent perforations (holes or voids) can be provided in the substrate at various intervals to quicken vapor egress time. The venting perforation void areas can be of various aperture size, shape and design to suit the particular food product. The vent apertures also permit increased direct entry of microwave energy into the food product (i.e., without being partially blocked by the susceptor material) for quicker internal cooking. FIGS. 4–8 illustrate various modifications of the substrate 12 that can be made to provide the substrate with an uneven surface.

Figure 4:
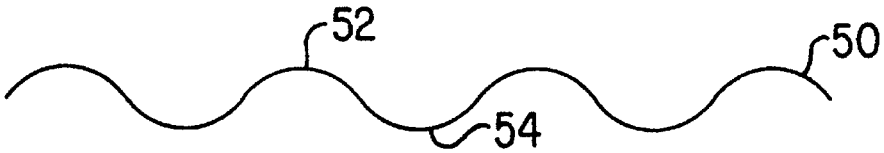
FIG. 4 is a side view of a first modification in which the substrate is provided with smooth undulations.
Figure 5:
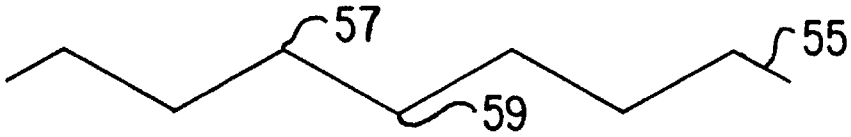
FIG. 5 is a side view of a second modification in which the substrate is provided with pointed undulations.
Figure 6:
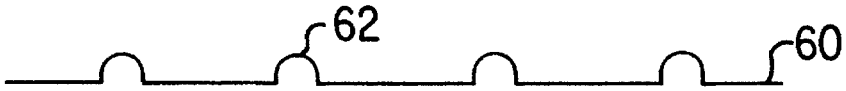
FIG. 6 is a side view of a third modification in which the substrate is provided with smooth ridges.
Figure 7:
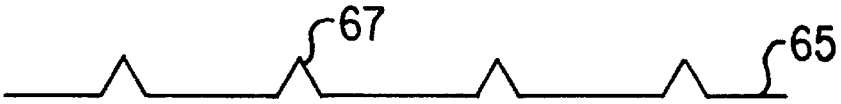
FIG. 7 is a side view of the fourth modification in which the substrate is provided with pointed ridges.
Figure 8:
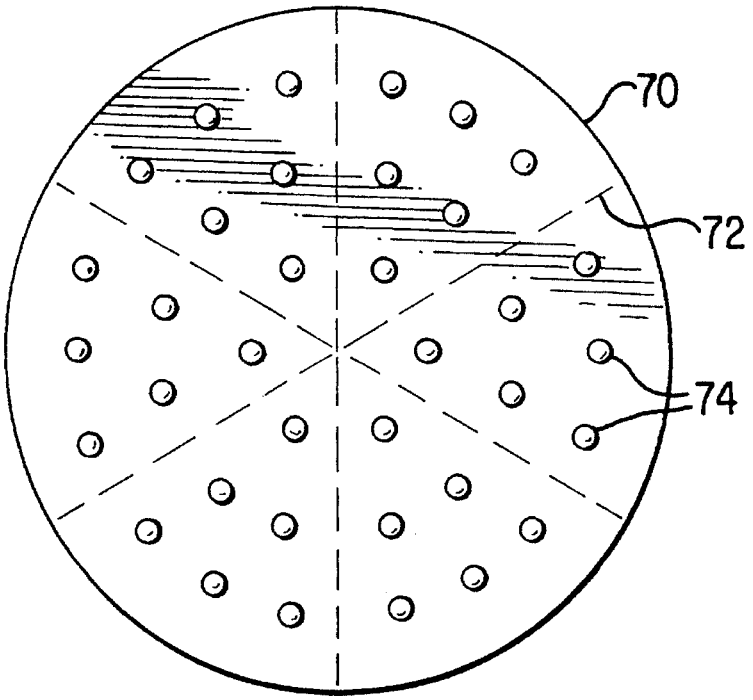
FIG. 8 is a top view of a fifth modification in which the support is provided with dimples on its upper surface.

FIG. 4 illustrates a first modified substrate 50 in which the substrate includes undulations having smooth peaks 52 and smooth troughs 54. FIG. 5 is a side view of a second modified substrate 55 having undulations with pointed peaks 57 and pointed troughs 59 (i.e., creases). FIG. 6 shows a third modified substrate 60 that is flat with the exception of smooth ridges 62 (raised elements) that extend across parts or the entire width of the substrate 60. The ridges can be formed by embossing the substrate, for example. FIG. 7 shows a fourth modified substrate 65 that is similar to the FIG. 6 modification, except that the ridges 67 are pointed. FIG. 8 is a top view of a fifth modification in which tray 70 includes raised dimples 74. The dimples can be smooth or pointed, and would have a side view similar to that shown in FIGS. 6 or 7. Raised ridges are raised islands of various shapes and designs also will create the desired uneven surface to allow vapor to escape. The FIG. 8 embodiment also illustrates that the tear perforation lines 72 can divide the tray 70 into six equally sized and shaped portions instead of eight portions as in FIG. 1.

Figure 9:
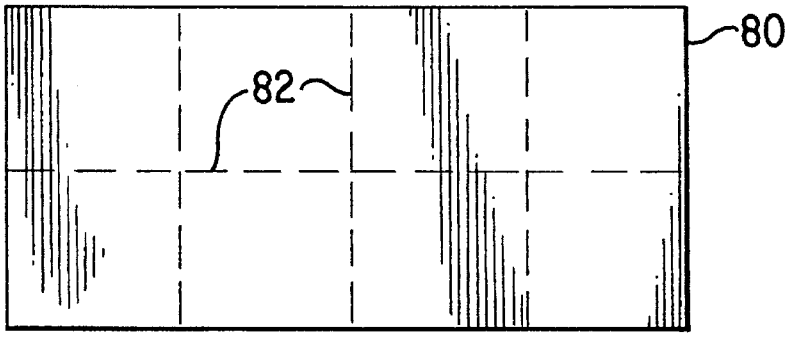
FIG. 9 is a top view of a second embodiment of the invention in which the support is rectangular and the tear perforation pattern divides the support into rectangular portions.

It will be appreciated that the substrate can have shapes other than round. For example, as shown in FIG. 9, a rectangular substrate 80 can be provided with a tear perforation pattern comprised of lines 82 that divide tray 80 into rectangular or square portions. Additionally, the substrate need not be perfectly flat; rather, it could be preformed and include up-turned edges forming a rim, with the tear perforations extending through the rim if desired. It is envisioned that both slit (i.e., tear) perforations and hole (i.e., vent) perforations may extend from the base through the rim, walls and lip if desired.

Figure 10:
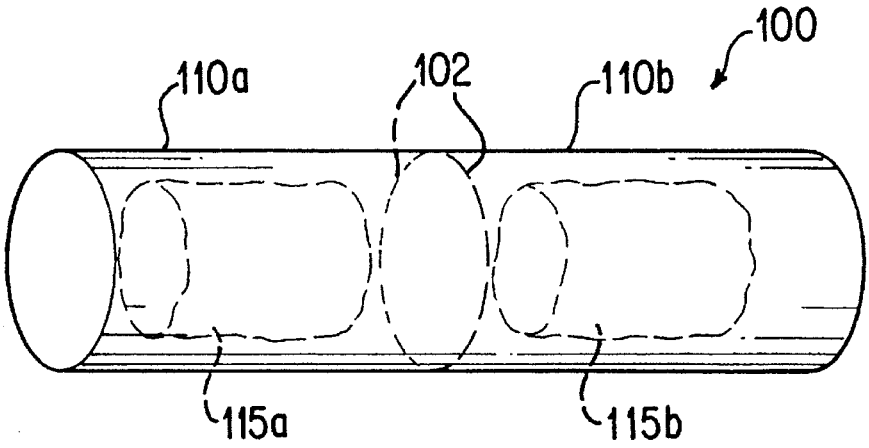
FIG. 10 is a perspective view of a third embodiment of the invention in which a support in the form a cylindrical sleeve holding multiple food products includes tear perforations enabling the sleeve to be separated into smaller sleeves, each containing a single food product.

As shown in FIG. 10, according to a third embodiment, the support is in the form of a cylindrical sleeve 100. Cylindrical sleeve 100 holds multiple food products, such as, for example, two spring rolls 115*a*, 115*b*. A tear perforation pattern 102 extends around the cylindrical sleeve 100 so as to divide it into two smaller sleeves 110*a*, 110*b*, each containing a single spring roll. Accordingly, when a person chooses to heat only one spring roll, the person can separate sleeve 100 into smaller sleeves 110*a*, 110*b* and heat only one of the spring rolls.

Of course, other food products could be packaged in a tear perforated sleeve. Additionally, the sleeve could be rectangular shaped instead of cylindrical and have venting perforation voids and/or raised dimples or ridges, and can have closed ends so as to be box-like.

Additional examples and features of the invention are illustrated in the embodiments of FIGS. 11–22. These embodiments illustrate the manner in which tear perforations can be used with flexible susceptor wraps, usually provided in rolls, as well as with flat trays as described above, preformed trays, tubes and sleeves as discussed above, and preformed bags or pouches. As detailed above, tear perforations can be provided so that a larger substrate containing a susceptor material can be separated into smaller portions. Additionally, raised surfaces (e.g., creases, elongated ridges, dimples, etc.) can be used to allow steam to escape from the surface of the food product, thus increasing the browning effect. Additionally, vent perforations, i.e., holes or voids, can be provided to assist in venting steam away from the food product. Additionally, the vent perforations reduce the surface area of susceptor material to allow microwaves to directly enter the food without being intercepted by susceptor material. This decreases the cooking time of the food product and prevents overheating of the susceptor material. The voids can be designed (sized, shaped and/or patterned) so that the inner portions of the food reach an optimal temperature at the same time of the desired crisping and browning effect of the crust.

Figure 11:
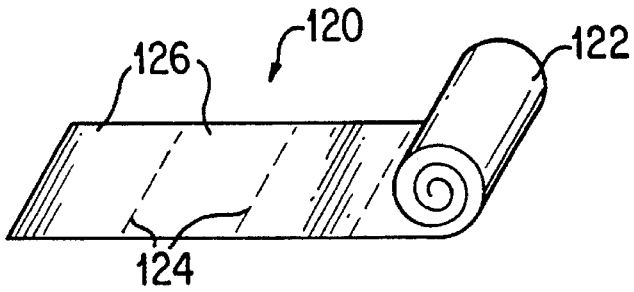
FIG. 11 shows a roll of susceptor wrap having lines of tear perforations.

FIG. 11 illustrates a flexible wrap 120. Flexible wrap 120 is comprised of, for example, the material illustrated in FIG. 2. Additionally, as detailed above, a second layer of stock material such as paper can be provided over protective layer 14, forming a tri-lamination. The susceptor material in flexible wrap 120 can be continuous (i.e., extend across the entire area of the wrap) or discontinuous. The flexible wrap 120 is provided as a roll 122. Tear perforation patterns 124 are provided and extend across the entire width of flexible wrap 120 so that the flexible wrap can be separated into individual pieces 126.

The roll of FIG. 11 can include other or additional lines of tear perforations, for example, one or more lines of tear perforations extending along the length of the roll, perpendicular to the lines 124. The substrate can contain multiple square (or other shaped) portions in the form of a checker board, for example, so that any size portion of material can be separated without the use of scissors.

Figure 12:
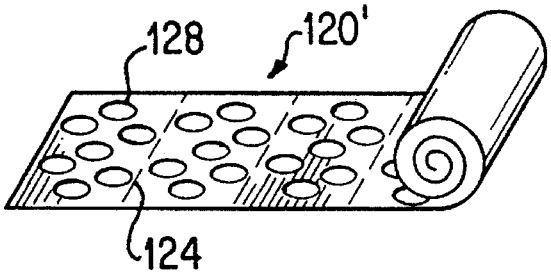
FIG. 12 shows the FIG. 11 roll modified to include vent perforations.

The flexible wrap 120' of FIG. 12 includes tear perforation line patterns 124 and voids 128. The voids are perforations larger in size than the tear perforations (which usually are slits). Unlike the tear perforations 124, which do not remove any susceptor material, the vent perforations 128 produce large voids that allow steam to escape from the cooking food product and also permit microwaves to directly impinge upon the food product to reduce the cooking time. Voids can be circular as illustrated in FIG. 12, or have other shapes such as square, or crossed, for example.

Figure 13:
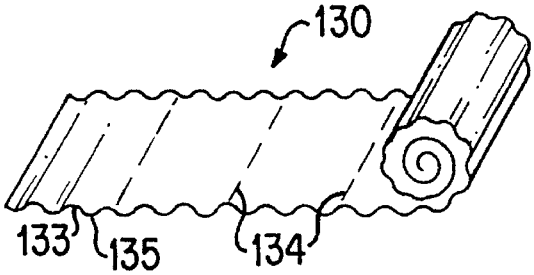
FIG. 13 shows the FIG. 11 roll modified to include raised portions in the form of creases.
Figure 14:
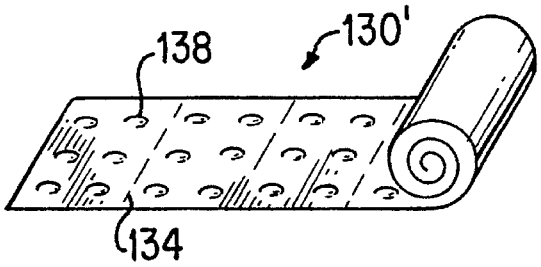
FIG. 14 shows the FIG. 11 roll modified to include raised portions in the form of dimples.

The flexible wrap 130 of FIG. 13 is embossed or includes creases so that the food product will rest upon the raised ridges (which can be curved or pointed as illustrated in FIGS. 4 and 5). This allows a space to be provided between the food surface and the susceptor, permitting steam to easily escape, thereby improving crisping of the food product. Tear perforations 134 are also provided across the width of flexible substrate 130 and are similar to tear perforations 124 detailed above. The flexible substrate 130' of FIG. 14 includes raised portions in the form of dimples 138. Additionally, vent perforations can be provided in the flexible substrates 130 or 130' of FIGS. 13 and 14 to further assist in venting steam from the food product. The vent perforations are particularly useful in combination with the raised portions so that steam generated near a center of the food product, for example, can immediately be vented away from the food product surface (via the vent perforations located near a central portion of the wrap) as opposed to having to travel to the edge of the wrap when no vent perforations are provided.

Figure 15:
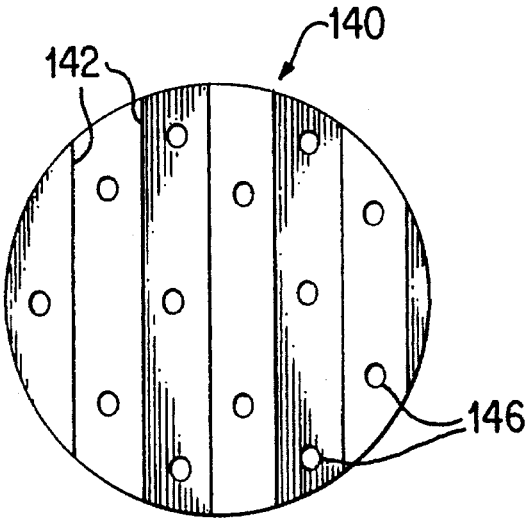
FIG. 15 shows a creased susceptor tray including vent perforations.
Figure 16:
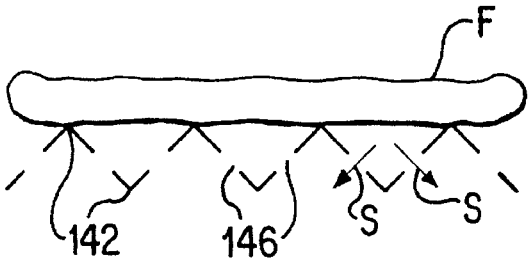
FIG. 16 is a side view of the FIG. 15 tray and illustrates vapors vented from the food product.

FIG. 15 illustrates a circular tray 140. The circular tray is constructed from a substrate similar to that illustrated in FIG. 1. Although not illustrated in FIG. 15, tray 140 can include tear perforation patterns as illustrated in FIG. 1, for example. Tray 140 includes creases 142 so as to provide raised portions, enabling steam to be vented away from the food product. The tray 140 also includes vent perforations 146 in the form of circular voids to enable further venting of steam away from the food product. The vent apertures located near a center of the tray enable the steam generated near a center of, for example, a pizza located on the tray, to be vented immediately from the pizza, instead of having to travel to the edge of the tray, as would be required if no vent perforations were provided. FIG. 16 is a side view of the FIG. 15 tray showing how steam S is vented away from food product F.

Figure 17:
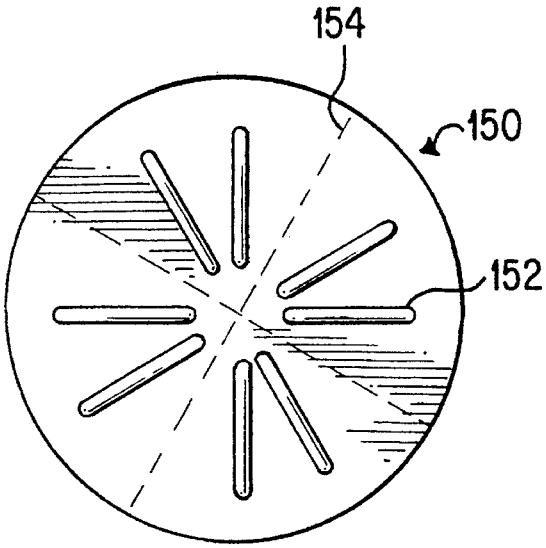
FIG. 17 is a top view of a perforated susceptor tray having raised ridges.
Figure 18:
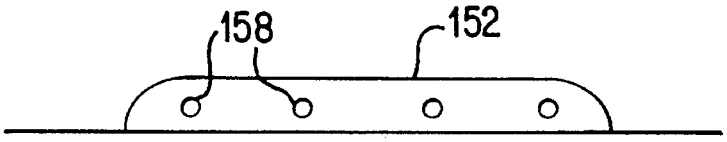
FIG. 18 is a side, cross-sectional view of the FIG. 17 ridge, illustrating vent perforations therein.

The tray 150 of FIG. 17 includes tear perforations 154 dividing the tray 150 into four equal size portions. Raised embossed ridges 152 are provided to facilitate venting. As illustrated in FIG. 18, which is a side, cross sectional view of one of the ridges 152, vent perforations in the form of circular voids 158 can be provided on side surfaces of the ridges 152. The vent perforations in combination with the ridges facilitates venting of steam away from the surface of the food product.

Figure 19:
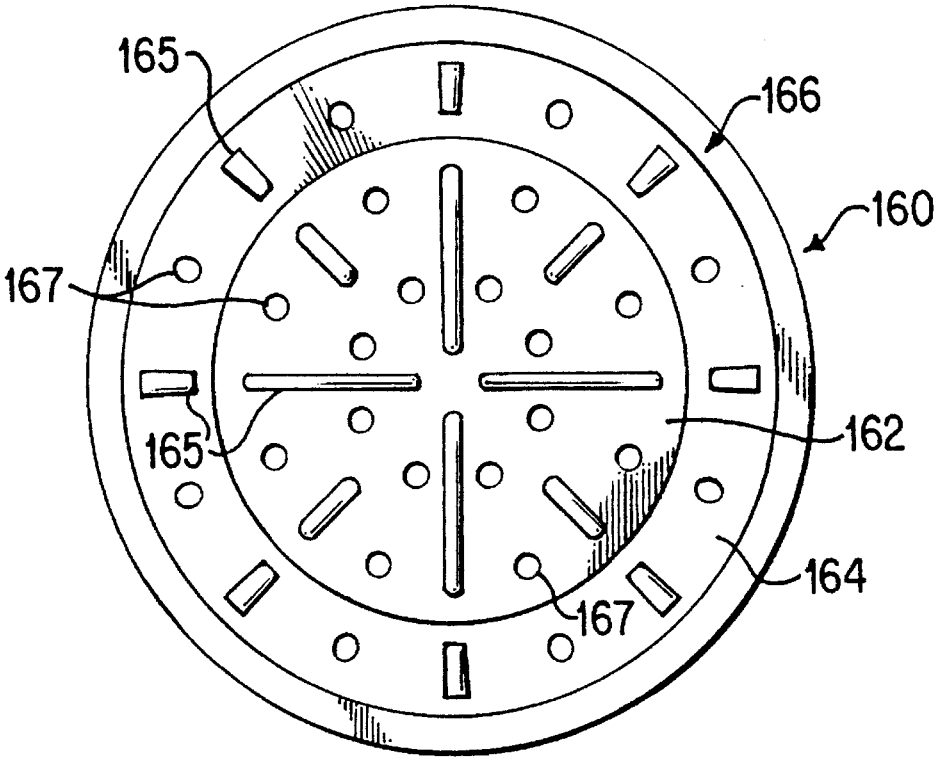
FIG. 19 is a preformed tray having raised portions and vent perforations.

FIG. 19 illustrates a preformed tray 160. The tray includes a bottom portion 162, sloped side portion 164, and a lip 166. Although not shown in FIG. 19, tear perforations can be provided to enable easy separation of tray 160 into smaller portions. The tray also includes rectangular-shaped raised portions 165 on the bottom portion 162 and on the inclined side portion 164 to facilitate venting of steam away from the food product, for example, a pie crust located in tray 160. Vent perforations in the form of circular voids 167 also can be provided in the tray as illustrated in FIG. 19. The vent perforations also can be provided on side walls of the raised portions 165 (as shown in FIG. 18) to further facilitate egress of vapor from the food product surface. A lid can be provided for the tray, the lid including tear perforation line(s) and/or raised portions and/or vent perforations. This would be useful with meat pies having a crust on the bottom, sides and top.

Figure 20:
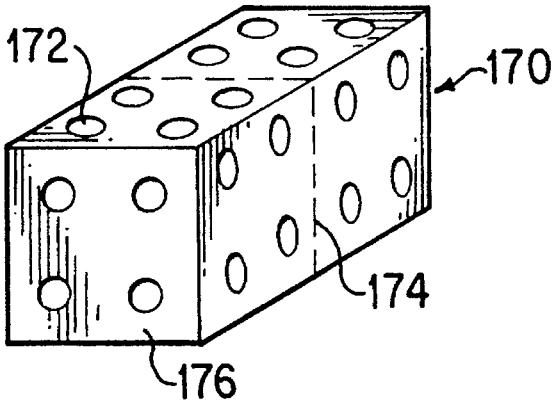
FIG. 20 is a box-like sleeve having tear perforations and vent perforations.

FIG. 20 illustrates a sleeve 170 having a square cross section. The sleeve 170 includes a line of tear perforations 174 that enable the sleeve to be separated easily into smaller portions. Vent perforations in the form of circular voids 172 are provided in sleeve 170 to facilitate venting of steam away from the food product. An end wall 176 also is provided on the sleeve so that the sleeve is in the form of an enclosed box. Although not shown in FIG. 20, raised portions can be provided instead of vent perforations 172 or in combination with vent perforations 172 in order to further facilitate venting.

Figure 21:
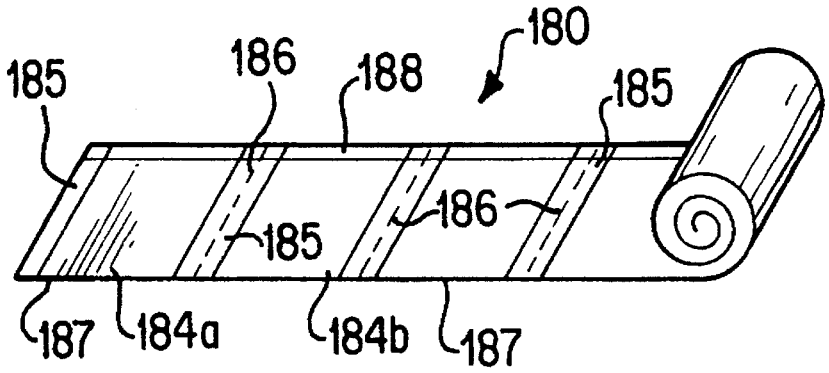
FIG. 21 is a roll of bags or pouches separated by tear perforation lines.

FIG. 21 illustrates a continuous roll 180 of bags. The continuous roll 180 can be formed by heat sealing two strips of the substrate shown in FIG. 2 to one another, for example. When a heat-sealable material is used as protective layer 14, two strips of the material are placed against each other with their corresponding layers 14 abutting one another. Heat is applied in appropriate locations by a conventional heat sealing apparatus, for example, in order to form the sides and bottom of each bag. See, for example, U.S. Pat. No. 5,059,436, the disclosure of which is incorporated herein by reference. Referring to FIG. 21, the two strips of material are heat sealed to each other at areas 185 to form sides of each bag, e.g., bags 184*a*, 184*b*. Additionally, the two strips of material are heat sealed to each other to form a bottom of the bag at area 187. A line of tear perforations 186 can be provided in each of the heat seal areas 185 defining sides of the bags so that each individual bag 184*a*, 184*b*, etc., can be separated from the roll of bags 180. Each bag includes an open top portion 188. Accordingly, a roll 180 of bags 184*a*, 184*b*, etc., is provided.

As an alternative, instead of using a heat seal to form the bottom portion 187 of each bag, a single strip of material can be folded in half, with the fold forming the bottom portion 187 of each bag. Then, the folded material can be heat sealed to itself to form side wall areas 185, and tear perforations can be formed therein as detailed above. As another alternative, the susceptor material can be removed from (or not placed on) the base material layer in the areas of the sides and bottom, although this is not necessary when a heat sealable material is used as layer 14, and a material such as paper, for example, is used as layer 18. Additionally, dry lamination (cold seals), extruded lamination and adhesives can be used to form the side and/or bottom seams.

Figure 22:
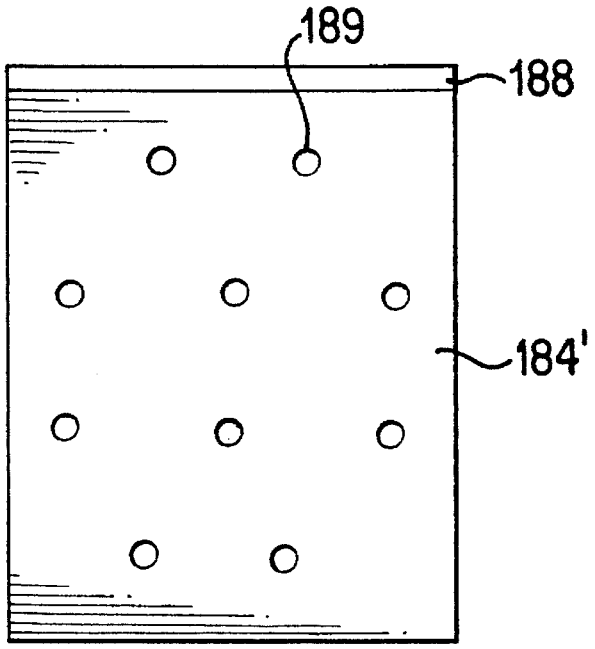
FIG. 22 is a pouch or bag containing vent perforations.

FIG. 22 illustrates a modified bag 184' in which vent perforations 189 are provided in one or both of the sides of the bag. The bag still includes an open upper portion 188 as detailed above, and can be provided in roll form with tear perforations used to separate each bag.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. A microwave reheating support that is configurable to food products having a variety of different shapes and sizes for heating the food products, said support comprising:

a substrate including a base layer and a microwave susceptor layer that increases in temperature when exposed to microwave energy;

said substrate including:

a first perforation line pattern including a plurality of perforation lines, at least some of said perforation lines in said first perforation line pattern crossing each other at an intersection point, and a second perforation line pattern including a perforation line spaced inwardly from an outer circumference of said substrate so that an outer peripheral portion of said substrate can be removed by tearing said second perforation line pattern, said second perforation line pattern intersecting at least two of the plurality of perforation lines of said first perforation line pattern at locations other than said intersection point, said perforation lines in said first and said second perforation line patterns enabling said substrate to be configured so that said substrate can be adjusted in size and shape so as to be custom-fitted to the food products having the variety of different shapes and sizes.

2. The support of claim 1, wherein said substrate includes a protective layer, said susceptor layer located between said base layer and said protective layer.

3. The support of claim 2, wherein said protective layer is a polyethylene-terephthalate layer.

4. The support of claim 1, wherein said base layer is a paperboard layer.

5. The support of claim 1, wherein said susceptor layer is an aluminum layer.

6. The support of claim 1, wherein said substrate is round and said intersection point is at a center of said round substrate.

7. The support of claim 6, wherein said second perforation line pattern includes a round pattern of tear perforations that is spaced radially inward from the outer circumference of said round substrate.

8. The support of claim 7, wherein said first perforation line pattern includes a plurality of said perforation lines that extend entirely across and through the center of said circular substrate to divide said circular substrate into plural wedges.

9. The support of claim 1, wherein said substrate includes an uneven surface that contacts a food product during use.

10. The support of claim 9, wherein said uneven surface includes elongated ridges.

11. The support of claim 10, wherein said ridges are smooth.

12. The support of claim 10, wherein said ridges are pointed.

13. The support of claim 10, wherein said raised dimples are pointed.

14. The support of claim 9, further comprising a plurality of voids extending through said substrate, said voids provided in portions of said substrate that do not contact the food product during use.

15. The support of claim 1, wherein said substrate includes undulations.

16. The support of claim 15, wherein said undulations are smooth.

17. The support of claim 15, wherein said undulations are pointed.

18. The support of claim 1, wherein a surface of said substrate that contacts a food product during use includes raised dimples.

19. The support of claim 18, wherein said raised dimples are smooth.

20. The support of claim 1, wherein said substrate is rectangular.

21. The support of claim 1, further comprising a package surrounding said substrate, and a food product on said substrate in said package.

22. The support of claim 1, further comprising a plurality of voids extending through said substrate.

23. The support of claim 22, wherein said voids are circular in shape.

24. The support of claim 1, wherein said perforation lines of said first perforation line pattern that cross at said intersection point also extend entirely across said substrate.

25. The support of claim 1, wherein said substrate is round.

26. The support of claim 1, wherein said perforation line of said second perforation line pattern is round.

27. The support of claim 1, wherein said intersection point is at a center of said substrate.

28. The support of claim 27, wherein said perforation lines of said first perforation line pattern that cross at said intersection point also extend entirely across said substrate.

29. A support for use in heating a food product using microwave energy, said support comprising:

a substrate including a base layer and a microwave susceptor layer that increases in temperature when exposed to microwave energy;

said substrate including:

a first perforation line pattern including at least two straight perforation lines that intersect each other at an intersection point and that extend from an outer edge of said substrate to at least said intersection point, and a second perforation line pattern including a perforation line spaced inwardly from an outer circumference of said substrate so that an outer peripheral portion of said substrate can be removed by tearing said second perforation line pattern, said second perforation line pattern intersecting the at least two straight perforation lines of said first perforation line pattern at locations other than said intersection point of said at least two straight lines.

30. The support of claim 29, further comprising a package surrounding said substrate, and a pizza on said substrate in said package.

31. The support of claim 29, wherein said substrate is round.

32. The support of claim 31, wherein said perforation line of said second perforation line pattern is round.

33. The support of claim 29, wherein said perforation line of said second perforation line pattern is round.

34. The support of claim 29, wherein said intersection point is at a center of said substrate.

35. A support that can be configured into a variety of different shapes and sizes for heating a variety of different food products using microwave energy, said support comprising:

a substrate including a base layer and a microwave susceptor layer that increases in temperature when exposed to microwave energy;

said substrate including:

a first perforation line pattern of tear perforations, said first perforation line pattern including at least two straight lines of perforations that extend entirely across and through a center of said substrate, thereby crossing each other at said center of said substrate, and a second perforation line pattern including a perforation line spaced inwardly from an outer circumference of said substrate so that an outer peripheral portion of said substrate can be removed by tearing said second perforation line pattern, said second perforation line pattern intersecting the at least two straight lines of perforations at locations other than said center of said substrate, so that said substrate can be configured to adjust the size and shape of the substrate to correspond to the size and shape of the food product that is being heated.

36. The tray of claim 35, wherein said second perforation line pattern includes a circular perforation line that is spaced radially inward from the outer circumference of said substrate.

37. The support of claim 35, further comprising a package surrounding said substrate, and a pizza on said substrate in said package.

38. The support of claim 35, wherein said substrate is round.

39. The support of claim 38, wherein said perforation line of said second perforation line pattern is round.

40. The support of claim 35, wherein said perforation line of said second perforation line pattern is round.

41. A microwave reheating support that is configurable to food products having a variety of different shapes and sizes for heating the food products, said support comprising:

a substrate including a base layer of paperboard stock material and a microwave susceptor layer that increases in temperature when exposed to microwave energy;

said substrate including:

a first perforation line pattern including a plurality of tear perforation lines formed by perforations that extend entirely through said substrate, at least some of said tear perforation lines crossing each other at an intersection point, and a second perforation line pattern including a tear perforation line spaced inwardly from an outer circumference of said substrate so that an outer peripheral portion of said substrate can be removed by tearing said second perforation line pattern, said second perforation line pattern intersecting at least two of the plurality of tear perforation lines in said first perforation line pattern, at least some of said tear perforation lines in said first and second perforation line patterns enabling said substrate to be seperated into portions so that said substrate can be adjusted in size and shape to correspond to the size and shape of the food products being heated.

42. The support of claim 41, wherein said substrate includes a plurality of voids that enable microwaves to directly pass therethrough while allowing passage therethrough of vapor generated by an adjacent food product.

43. The support of claim 42, wherein said substrate is a performed substrate having a sloped side portion, said voids being located at least in said sloped side portion.

44. The support of claim 42, wherein said voids are circular.

45. The support of claim 41, wherein said substrate is a flat tray.

46. The support of claim 41, wherein said perforation lines of said first perforation line pattern that cross at said intersection point also extend entirely across said substrate.

47. The support of claim 41, wherein said substrate is round.

48. The support of claim 41, wherein said perforation line of said second perforation line pattern is round.

49. The support of claim 41, wherein said intersection point is at a center of said substrate.

50. The support of claim 49, wherein said perforation lines of said first perforation line pattern that cross at said intersection point also extend entirely across said substrate.

* * * * *